US009176433B2

(12) United States Patent
Okamoto

(10) Patent No.: US 9,176,433 B2
(45) Date of Patent: Nov. 3, 2015

(54) TRANSFER DEVICE OF IMAGE FORMING DEVICE INCLUDING MONOCHROMATIC AND FULL COLOR TRANSFER MODES

(75) Inventor: Shotaro Okamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/344,537

(22) PCT Filed: Aug. 3, 2012

(86) PCT No.: PCT/JP2012/069838

§ 371 (c)(1),
(2), (4) Date: Dec. 16, 2014

(87) PCT Pub. No.: WO2013/038834

PCT Pub. Date: Mar. 21, 2013

(65) Prior Publication Data

US 2015/0147100 A1 May 28, 2015

(30) Foreign Application Priority Data

Sep. 15, 2011 (JP) ..... 2011-201338

(51) Int. Cl.
*G03G 15/01* (2006.01)
*G03G 15/16* (2006.01)

(52) U.S. Cl.
CPC ..... *G03G 15/1605* (2013.01); *G03G 15/0136* (2013.01); *G03G 15/0189* (2013.01); *G03G 15/1615* (2013.01); *G03G 2215/0193* (2013.01)

(58) Field of Classification Search
CPC ..... G03G 15/0131; G03G 15/0136; G03G 15/0178; G03G 15/0189; G03G 2215/0119; G03G 2215/0122; G03G 2215/0125; G03G 2215/0138; G03G 2215/0141; G03G 2215/0193; G03G 15/1615; G03G 15/1605
USPC ..... 399/66, 298, 299, 302, 303
See application file for complete search history.

(56) References Cited

U.S. PATENT DOCUMENTS

| | | | | |
|---|---|---|---|---|
| 7,392,001 | B2 * | 6/2008 | Okazaki | 399/299 |
| 7,599,651 | B2 * | 10/2009 | Kitagawa et al. | 399/302 |
| 8,923,717 | B2 * | 12/2014 | Izumi et al. | 399/66 |
| 2003/0038955 | A1 * | 2/2003 | Yamada et al. | 358/1.9 |
| 2012/0003006 | A1 * | 1/2012 | Tachiki | 399/121 |
| 2012/0057908 | A1 * | 3/2012 | Meguro | 399/313 |
| 2013/0136498 | A1 * | 5/2013 | Ju et al. | 399/121 |

FOREIGN PATENT DOCUMENTS

| | | | |
|---|---|---|---|
| JP | 08110587 | A * | 4/1996 |
| JP | 2006-201338 | A | 8/2006 |
| JP | 2010-134149 | A | 6/2010 |
| JP | 2010-271587 | A | 12/2010 |

* cited by examiner

*Primary Examiner* — Robert Beatty
(74) *Attorney, Agent, or Firm* — Keating & Bennett, LLP

(57) ABSTRACT

An image forming apparatus prevents link members for monochrome and for color from coming off while suppressing an increase in rotatory torque and a deficiency of clutch capacity for transmitting a driving force to a cam shaft. Coming-off protection sections for preventing the coming off of a second link member which is the link member for color is provided in a cam section for monochrome. In other words, it is not necessary to provide a coming-off protection section in a second cam section which is a cam section for color requiring a large rotatory torque. This eliminates the need for a coming-off protection section of the cam section for color to act on the link member for color when a cam is turned by a driving source.

6 Claims, 8 Drawing Sheets

TRANSFER DEVICE OF IMAGE FORMING DEVICE INCLUDING MONOCHROMATIC AND FULL COLOR TRANSFER MODES

CROSS-REFERENCE TO RELATED APPLICATIONS

This application is the U.S. national phase, pursuant to 35 U.S.C. §371, of PCT international application Ser. No. PCT/JP2012/069838, filed Aug. 3, 2012, designating the United States and published in Japanese on Mar. 21, 2013 as publication WO2013/038834. PCT/JP2012/069838 claims priority to Japanese Patent Application Ser. No. 2011-201338, filed Sep. 15, 2011. The entire contents of the aforementioned patent applications are incorporated herein by reference.

TECHNICAL FIELD

The present invention relates to a transfer device that transfers a toner image from a plurality of image bearing members onto a paper sheet through an intermediate transfer belt.

BACKGROUND ART

A transfer device according to the intermediate transfer method is known that is installed in an image forming apparatus adopting the electrophotography method in which toner images are transferred in such a manner as to be superimposed sequentially from a plurality of image bearing members onto an intermediate transfer belt in the primary transfer and then the toner image is transferred from the intermediate transfer belt onto a paper sheet in the secondary transfer.

Among the image forming apparatus are ones that have operational modes such as monochromatic transfer mode, full-color transfer mode, and standby mode in which no image forming is performed. The intermediate transfer belt is in contact with only an image bearing member for black in the monochromatic transfer mode, is in contact with all the image bearing members in the full-color transfer mode, and is separate from all the image bearing members in the standby mode.

For example, transition between the intermediate transfer belt's contact with and separation from the image bearing members is achieved by causing a plurality of primary transfer rollers respectively facing each of the plurality of image bearing members across the intermediate transfer belt to be displaced in directions for the transition between the contact and the separation (for example, refer to Patent Literature 1).

The conventional transfer device as described in the Patent Literature 1 that is provided with a link member for monochrome to cause a primary transfer roller for monochrome that corresponds to a black toner image to be displaced in the contact-separation directions, a link member for color to cause primary transfer rollers for color that correspond to toner images of the three primary colors (cyan, magenta and yellow) to be displaced in the contact-separation directions, and a transfer member moving mechanism that includes a cam to move the link member for monochrome and the link member for color respectively and a driving source to turn the cam. The cam is formed in an eccentric cam made up of a cam section for monochrome and a cam section for color that are to be turned around an identical cam shaft, both sections being displaced from one another in a direction of the cam shaft and fixed to each other. The respective cam sections for monochrome and for color are in contact with one end of respective link members for monochrome and for color at a portion in each peripheral surface of the respective cam sections.

The peripheral surface of each cam section is made up of a circular arc part (hereinafter referred to as a pressed-contact generating face) at which a distance (radius) from a center of rotation of the cam becomes greatest, and a part at which the radius becomes shorter (hereinafter referred to as a release generating face) than the former. While the link member is in contact with the pressed-contact generating face of the cam section, the link member moves along its longitudinal direction in a direction to go farther from the cam shaft, and then the primary transfer roller is displaced in a direction to approach the image bearing member, thereby causing the intermediate transfer belt to be pressed against the image bearing member. On the other hand, while the link member is in contact with the release generating face of the cam section, the link member moves along its longitudinal direction in a direction to come closer to the cam shaft, and then the primary transfer roller is displaced in a direction to separate from the image bearing member, thereby causing the intermediate transfer belt to be released from the image bearing member. In this manner, the intermediate transfer belt is caused to be pressed against and be released from the image bearing member for monochrome by the link member for monochrome moving along its longitudinal direction; and the intermediate transfer belt is caused to be pressed against and be released from the image bearing members for color by the link member for color moving along its longitudinal direction.

In the monochromatic transfer mode, the link member for monochrome is in contact with the pressed-contact generating face of the cam section for monochrome while the link member for color is kept in a state of being in contact with the release generating face of the cam section for color, thereby causing the primary transfer roller for monochrome to be displaced in a direction to approach the image bearing member for monochrome. In the full-color transfer mode, the link members for monochrome and for color are both kept in a state of being in contact with corresponding pressed-contact generating faces of the cam sections, thereby causing all the primary transfer rollers for monochrome and for color to be displaced in directions for the pressed contact. In the standby mode, the link members for monochrome and for color are both kept in a state of being in contact with corresponding release generating faces of the cam sections, thereby causing all the primary transfer rollers for monochrome and for color to be displaced in directions for the separation.

In each of the modes, the driving source to turn the cam is stopped. Therefore, there is a risk that sliding occurs between the peripheral surface of the cam section and the link member, and that thereby the cam unintentionally turns and then the link member comes off the pressed-contact generating face to the release generating face of the cam section. Due to the occurrence of such coming off of the link member, the amount of movement of the link member, namely the amount of displacement of the primary transfer roller, becomes unstable; therefore, a state of the pressed contact of the intermediate transfer belt with the image bearing member varies, from which a problem arises that a harmful effect is exerted on the transfer of the toner image.

CITATION LIST

Patent Literature

Patent Literature 1: Japanese Patent Unexamined Publication No. 2010-134149 bulletin

SUMMARY OF INVENTION

Technical Problem

Then, an attempt was made to prevent the coming off of the link members for monochrome and for color by providing coming-off protection sections that are formed with protrusions or the like on the peripheral surfaces of the cam sections for monochrome and for color.

The link member for color takes on the displacements of the three primary transfer rollers for color corresponding to the three primary colors. Accordingly, moving the link member for color requires a greater force than moving the link member for monochrome. The force required for moving the link members is supplied by a rotatory torque of the cam.

In the above-mentioned prior art, because the coming-off protection sections were provided for each of the cam section for monochrome and the cam section for color, a large load occurs particularly when the coming-off protection section of the cam section for color acts on the link member for color as the cam is turned by the driving source; and thus there have been problems that an increase of the rotatory torque and a deficiency of clutch capacity for transmitting the driving force to the cam shaft occur.

The present invention was contrived in view of the above-mentioned conventional problems, and is directed to providing a transfer device that is capable of preventing link members for monochrome and for color from coming off while suppressing an increase of a rotatory torque and a deficiency of clutch capacity for transmitting a driving force to a cam shaft.

Solution to Problem

A transfer device includes an intermediate transfer belt constituting a loop-like path of movement;

one image bearing member for monochrome;

a plurality of image bearing members for color;

one primary transfer member for monochrome capable of being displaced in contact-separation directions facing the one image bearing member for monochrome;

a plurality of primary transfer members for color capable of being displaced in contact-separation directions respectively facing the plurality of image bearing members for color;

a cam formed in an eccentric cam made up of a cam section for monochrome and a cam section for color that are to be turned around an identical cam shaft, both sections being displaced from one another in a direction of the cam shaft and fixed to each other;

a first link member to which the one primary transfer member for monochrome is connected and which is urged toward the cam and which is movable along a longitudinal direction thereof within a predetermined range, being in contact with a peripheral surface of the first cam section; and a second link member to which the plurality of primary transfer members for color are connected and which is urged toward the cam and which is movable along a longitudinal direction thereof within a predetermined range, being in contact with a peripheral surface of the second cam section.

And the transfer device, in which the one image bearing member for monochrome and the one primary transfer member for monochrome that are disposed facing each other and the plurality of image bearing members for color and the plurality of primary transfer members for color that are disposed facing each other are disposed sequentially along the intermediate transfer belt sandwiching the intermediate transfer belt, can selectively take the modes below depending on a rotational angle of the cam:

a standby mode in which with the first link member and the second link member respectively kept in a state of being in contact with release generating faces of the first cam section and the second cam section the primary transfer member for monochrome and the primary transfer members for color are respectively caused to be displaced in directions to separate from the image bearing member for monochrome and the image bearing members for color, thereby causing the intermediate transfer belt to be released from the image bearing member for monochrome and the image bearing members for color;

a monochromatic transfer mode in which with the first link member kept in the state of being in contact with a pressed-contact generating face of the first cam section the primary transfer member for monochrome is caused to be displaced in a direction to approach the image bearing member for monochrome and thereby causes the intermediate transfer belt to be pressed against the image bearing member for monochrome, and in which with the second link member kept in the state of being in contact with the release generating face of the second cam section the primary transfer members for color are caused to be displaced in the directions to separate from the image bearing members for color and thereby causes the intermediate transfer belt to be released from the image bearing members for color; and a full-color transfer mode in which with the first link member and the second link member respectively kept in the state of being in contact with pressed-contact generating faces of the first cam section and the second cam section the primary transfer member for monochrome and the primary transfer members for color are respectively caused to be displaced in the directions to approach the image bearing member for monochrome and the image bearing members for color, thereby causing the intermediate transfer belt to be pressed against the image bearing member for monochrome and the image bearing members for color.

In the transfer device of the present invention, on the peripheral surface of the first cam section are provided together a first coming-off protection section for preventing the first link member from coming off the pressed-contact generating face to the release generating face of the first cam section in the monochromatic transfer mode, and a second coming-off protection section for preventing the second link member from coming off the pressed-contact generating face to the release generating face of the second cam section in the full-color transfer mode.

According to the configuration, the coming off prevention section for preventing the coming off of the second link member which is the link member for color is provided in the first cam section 233 which is the cam section for monochrome. In other words, it is not necessary to provide a coming-off protection section in the second cam section which is the cam section for color requiring a large rotatory torque. This eliminates the need for a coming-off protection section of the cam section for color to act on the link member for color when the cam is turned by a driving source, thereby making it possible to suppress the occurrence of an increase of the rotatory torque and a deficiency of clutch capacity for transmitting the driving force to the cam shaft.

Advantageous Effects of Invention

The present invention makes it possible to prevent the link members for monochrome and for color from coming off while suppressing the increase of the rotatory torque and the deficiency of clutch capacity for transmitting the driving force to the cam shaft.

DESCRIPTION OF EMBODIMENTS

Figure 1:
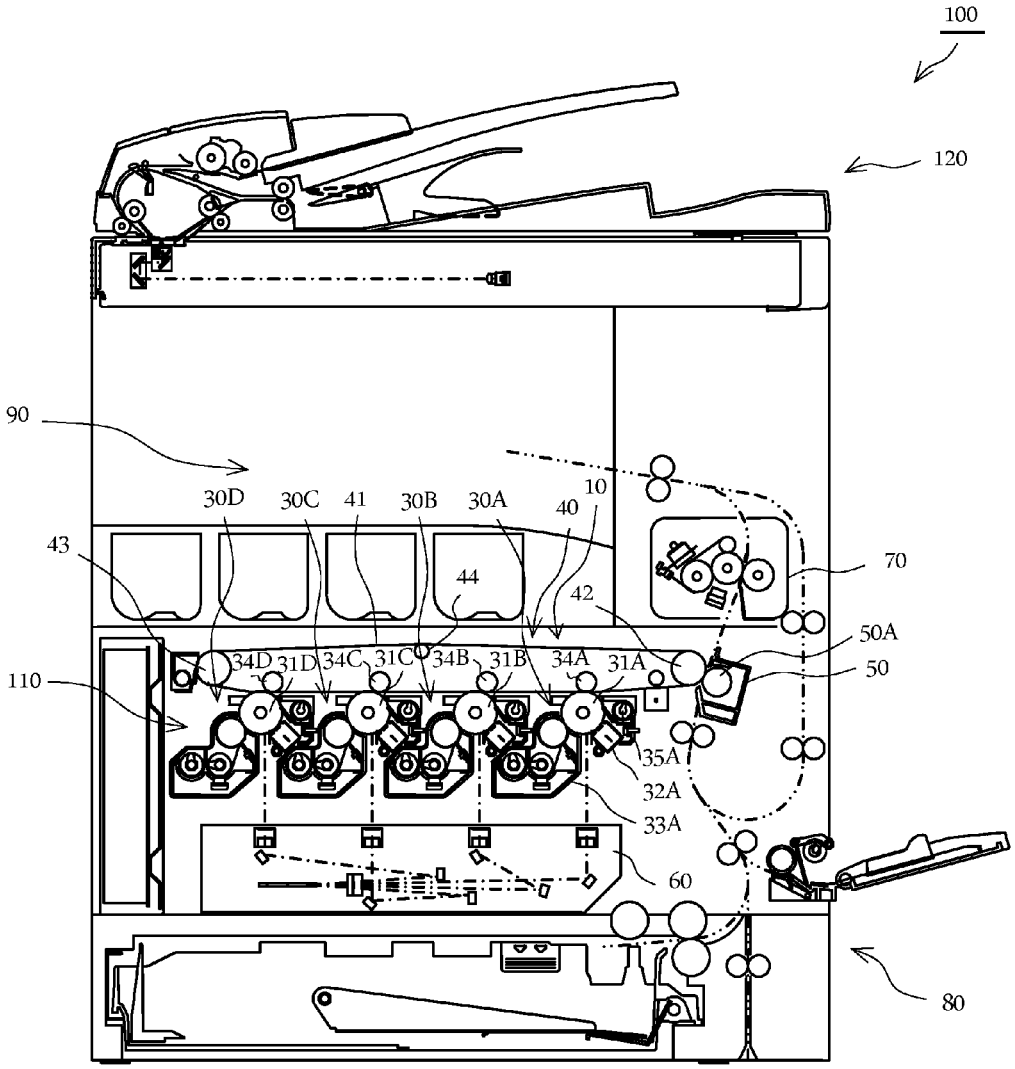
FIG. 1 is a general front sectional view of an image forming apparatus provided with a transfer device according to an embodiment of the present invention.

An image forming apparatus 100 that is provided with a transfer device 10 according to an embodiment of the present invention is explained below, referring to the drawings.

As shown in FIG. 1, the image forming apparatus 100 forms a multicolored or monochromatic image onto a predetermined paper sheet based on image data that have been read from a document. For the paper sheet, a sheet recording medium such as normal paper, thick paper, photographic paper, and OHP film can be exemplified. The image forming apparatus 100 broadly consists of four blocks. Namely, the image forming apparatus 100 is provided with an image reading unit 120 in the upper part of a main body, along with an image forming section 110, a paper feeding section 80, and a paper discharge section 90 that are provided in the main body. Since the present invention is an invention relating to a transfer device, explanation of a general configuration will be made hereinafter only on the image forming section 110 which is the block including the transfer device 10.

The image forming section 110 is provided with an intermediate transfer unit 40, image forming stations 30A, 30B, 30C, 30D, a secondary transfer unit 50, an exposure unit 60 and a fuser unit 70.

The intermediate transfer unit 40 includes an intermediate transfer belt 41 which is an endless belt, a first tension roller 42, a second tension roller 43 and a tension roller 44. The intermediate transfer belt 41 is passed over the first tension roller 42, the second tension roller 43 and the tension roller 44 being tensioned therewith. As an example, the first tension roller 42 is a drive roller, and the second tension roller 43 is an idle roller. The tension roller 44 adjusts the tensile force on the intermediate transfer belt 41.

The image forming stations 30A through 30D each perform an image forming process according to the electrophotography method using a toner of respective hues consisting of black, cyan, magenta and yellow. The image forming stations 30A through 30D are aligned to each other in such a manner as to face a predetermined region of the intermediate transfer belt 41. The image forming stations 30B through 30D are configured in the same manner as the image forming station 30A.

The image forming station 30A is provided with a photoreceptor drum for monochrome 31A that bears black toner. The image forming stations 30B, 30C, 30D are respectively provided with photoreceptor drums for color 31B, 31C, 31D that bear respective toners for color. The photoreceptor drums 31A through 31D each constitute an image bearing member.

The image forming station 30A has, around the photoreceptor drum 31A, an electrostatic charger 32A, a developing device 33A, a primary transfer roller 34A and a cleaning device 35A. Similarly, the image forming stations 30B, 30C, 30D have primary transfer rollers 34B, 34C, 34D, respectively.

The photoreceptor drum 31A is caused to rotate in a predetermined direction by a driving force transmitted from a drive source not illustrated. The electrostatic charger 32A charges a circumferential surface of the photoreceptor drum. 31A to a predetermined electrostatic potential.

The exposure unit 60 drives a semiconductor laser based on the image data on the respective hues of black, cyan, magenta and yellow, and distributes laser beams for the respective hues onto the respective photoreceptor drums 31A through 31D of the image forming stations 30A through 30D. On the circumferential surfaces of the photoreceptor drums 31A through 31D are formed electrostatic latent images based on the image data on the respective hues of black, cyan, magenta and yellow.

The developing device 33A supplies the circumferential surface of the photoreceptor drum 31A with the black toner which is the hue for the image forming station 30A, thereby rendering the electrostatic latent image visible in a black toner image.

An outer peripheral surface of the intermediate transfer belt 41 sequentially faces the photoreceptor drums 31A through 31D. The primary transfer roller 34A is disposed at a position facing the photoreceptor drum 31A across the intermediate transfer belt 41. The primary transfer roller 34B is disposed at a position facing the photoreceptor drum 31B across the intermediate transfer belt 41. The primary transfer roller 34C is disposed at a position facing the photoreceptor drum 31C across the intermediate transfer belt 41. The primary transfer roller 34D is disposed at a position facing the photoreceptor drum 31D across the intermediate transfer belt 41.

With an applied primary transfer bias of a polarity (for instance, plus) reverse to the electrostatic charge polarity (for instance, minus) of the toner, the primary transfer roller 34A carries out a primary transfer of the toner image borne on the photoreceptor drum 31A onto the outer peripheral surface of the intermediate transfer belt 41. The intermediate transfer unit 40 and the primary transfer rollers 34A through 34D are included in the transfer device 10.

The toner remaining on the outer circumferential surface of the photoreceptor drum 31A is removed by the cleaning device 35A.

In a monochromatic transfer mode, the above-mentioned image forming process is performed only at the image forming station for monochrome 30A. Then, in a full-color transfer mode, image forming processes similar to that at the image forming station 30A are also performed on the respective hues of cyan, magenta and yellow at the image forming stations 30B through 30D, in addition to the image forming station 30A. With the primary transfer bias applied to the respective primary transfer rollers 34A through 34D of the image forming stations 30A thorough 30D, the toner images of the respective hues of black, cyan, magenta and yellow are transferred sequentially in such a manner as to be superimposed to a single image on the outer peripheral surface of the intermediate transfer belt 41.

The secondary transfer unit 50 has a secondary transfer roller 50A. With a secondary transfer bias of a polarity (for instance, plus) reverse to the electrostatic charge polarity (for instance, minus) of the toner being applied to the secondary transfer roller 50A, the toner image borne on the outer peripheral surface of the intermediate transfer belt 41 is transferred onto the paper sheet. The secondary transfer unit 50 is included in the transfer device 10.

The fuser unit 70 fixes the toner image on the paper sheet by heating and pressing the paper sheet onto which the toner image has been transferred.

Figure 2A:
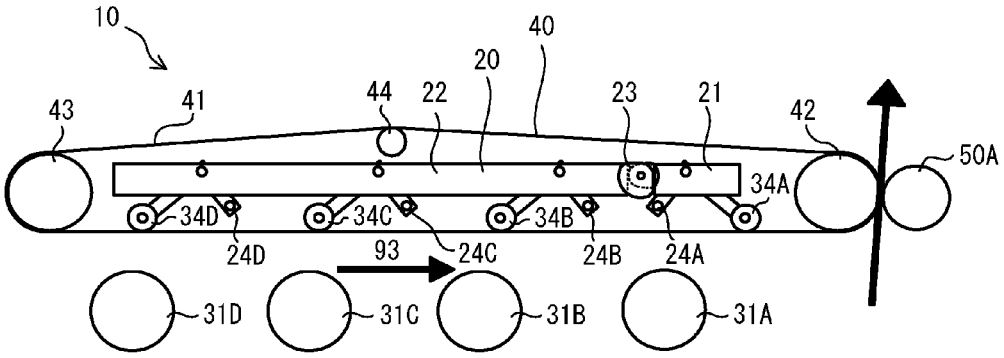
FIG. 2 is a front view showing a general configuration of the transfer device, with FIG. 2A showing a state of a standby mode, FIG. 2B showing a state of a monochromatic transfer mode, and FIG. 2C showing a state of a full-color transfer mode.
Figure 2B:
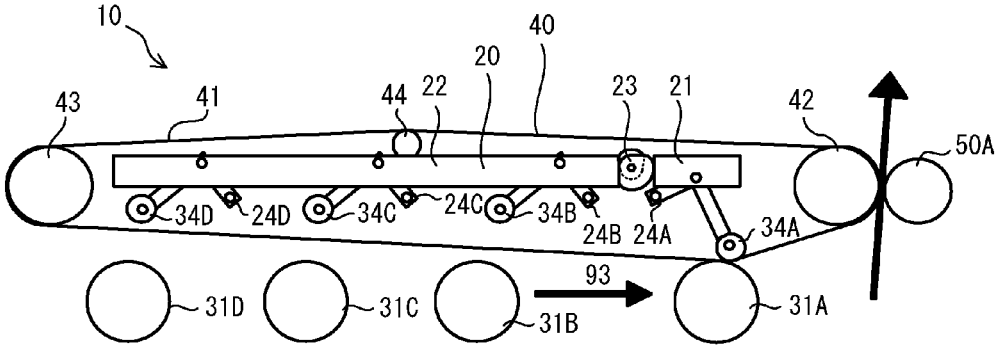
Figure 2C:
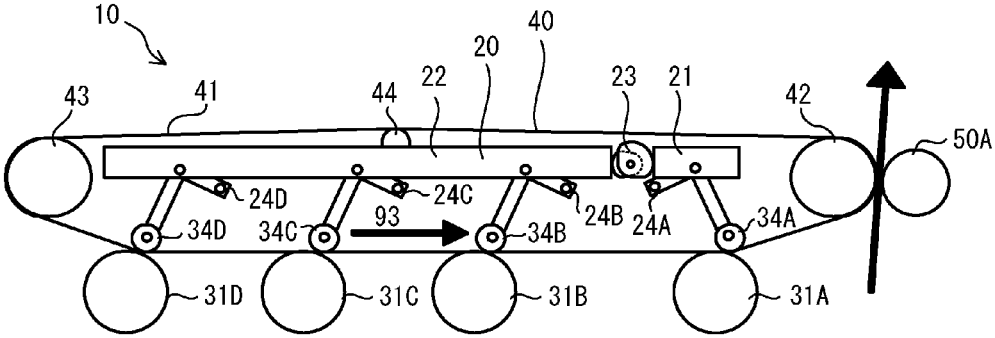

Subsequently, a configuration of the transfer device 10 is explained. As shown in FIG. 2A through FIG. 2C, the intermediate transfer belt 41 is passed over between the first tension roller 42 and the second tension roller 43 and tensioned therewith, thereby constituting a predetermined loop-like path of movement. Along the outer peripheral surface of the intermediate transfer belt 41 in the region facing the photoreceptor drums 31A through 31D, the photoreceptor drum 31D, the photoreceptor drum 31C, the photoreceptor drum 31B and the photoreceptor drum 31A are disposed in this order from the upstream side in a direction of movement 93 of the intermediate transfer belt 41. In the direction of movement 93, the first tension roller 42 is disposed on the downstream side, and the second tension roller 43 is disposed on the upstream side. As described above, the primary transfer rollers 34A through 34D are disposed at positions facing the respective photoreceptor drums 31A through 31D across the intermediate transfer belt 41. In the embodiment, the intermediate transfer belt 41 is disposed above the photoreceptor drums 31A through 31D.

Figure 3A:
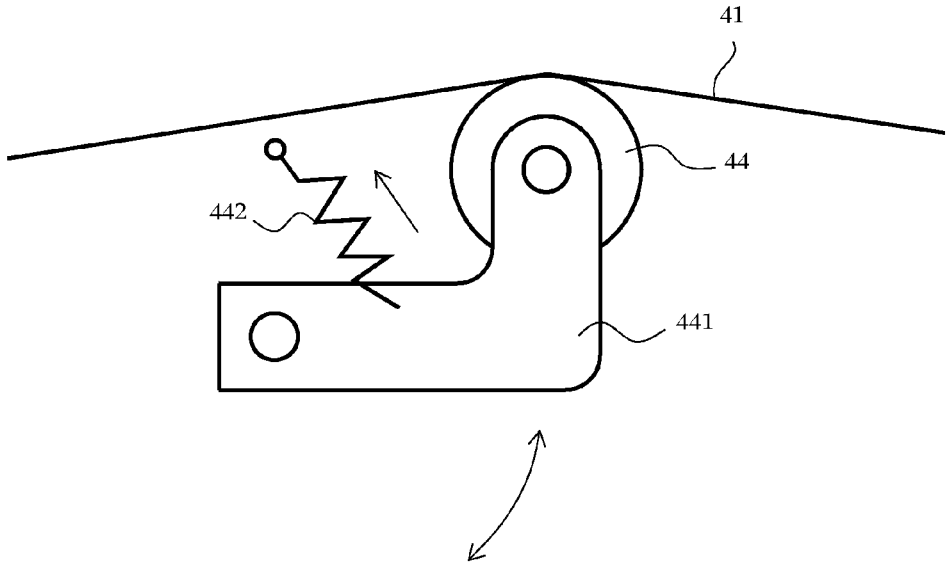
FIG. 3A is a drawing showing a configuration of a tension roller.

As shown in FIG. 3A, the tension roller 44 is in contact with pressure with the inner peripheral surface of the intermediate transfer belt 41. The tension roller 44 is rotatably supported at a tip portion of an arm 441. A root end portion of the arm 441 is rotatably supported by a frame (not shown) of the intermediate transfer unit 40. The arm 441 is urged by a spring 442 in such a direction that the tension roller 44 is caused to be pressed against the inner peripheral surface of the intermediate transfer belt 41. This allows the intermediate transfer belt 41 to be held at a constant tensile force throughout the time in a standby mode, a monochromatic transfer mode, and a full-color transfer mode.

The primary transfer rollers 34A through 34D are configured in such a manner as to be capable of being displaced in contact-separation directions in relation to the respectively facing photoreceptor drums 31A through 31D. This configuration allows the primary transfer roller 34A to be capable of being displaced at least between a pressing position where the intermediate transfer belt 41 is caused to be pressed against the facing photoreceptor drum 31A and a separate position where the intermediate transfer belt 41 is caused to be released from the facing photoreceptor drum 31A. The same manner applies to the primary transfer rollers 34B through 34D as to the primary transfer roller 34A.

As shown in FIG. 2A, in the standby mode, all the primary transfer rollers 34A through 34D are disposed at the respective separate positions, thereby causing the intermediate transfer belt 41 to be released from the photoreceptor drums 31A through 31D.

As shown in FIG. 2B, in the monochromatic transfer mode, the primary transfer roller for monochrome 34A is disposed at the pressing position, thereby causing the intermediate transfer belt 41 to be pressed against the photoreceptor drum 31A. On the other hand, the primary transfer rollers for color 34B through 34D are disposed at the respective separate positions, thereby causing the intermediate transfer belt 41 to be released from the photoreceptor drums 31B through 31D.

As shown in FIG. 2C, in the full-color transfer mode, all the primary transfer rollers 34A through 34D are disposed at the respective pressing positions, thereby causing the intermediate transfer belt 41 to be pressed against the photoreceptor drums 31A through 31D.

The displacements of the primary transfer rollers 34A through 34D in the contact-separation directions are performed by a transfer member moving mechanism 20.

Figure 4:
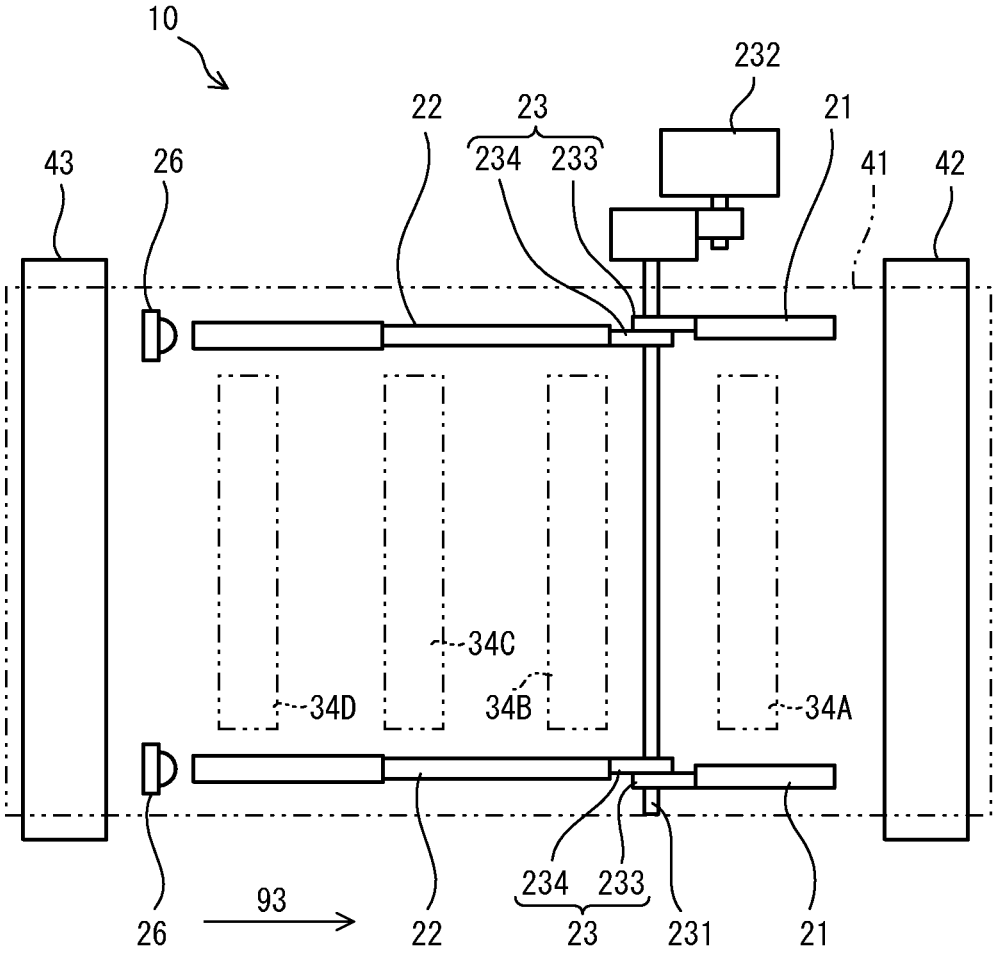
FIG. 4 is a general top view of the transfer device.

As shown in FIG. 4, the transfer member moving mechanism 20 includes a first link member 21, a second link member 22, a cam 23, and a first to fourth swinging members 24A, 24B, 24C, 24D.

Along the direction of movement 93 of the intermediate transfer belt 41, the cam 23 is disposed between the first link member 21 and the second link member 22. The first link member 21 and the second link member 22 are movable within predetermined ranges along their longitudinal directions, and are respectively urged toward the cam 23.

The first link member 21, the second link member 22 and the cam 23 are each disposed between the first tension roller 42 and the second tension roller 43 on both the front face's side and the rear face's side of the image forming apparatus 100. The primary transfer roller 34A is supported via a shaft by both the first link member 21 disposed on the front face's side and the first link member 21 disposed on the rear face's side. The primary transfer rollers 34B through 34D are supported via shafts by both the second link member 22 disposed on the front face's side and the second link member 22 disposed on the rear face's side.

The cam 23 on the front face's side and the cam 23 on the rear face's side are fixed on a single cam shaft 231, and turn around the cam shaft 231 in equiphase to each other. The cam shaft 231 is caused to turn by a motive power transmitted from a drive source 232. For example, for the drive source 232, a stepping motor is used.

Figure 5A:
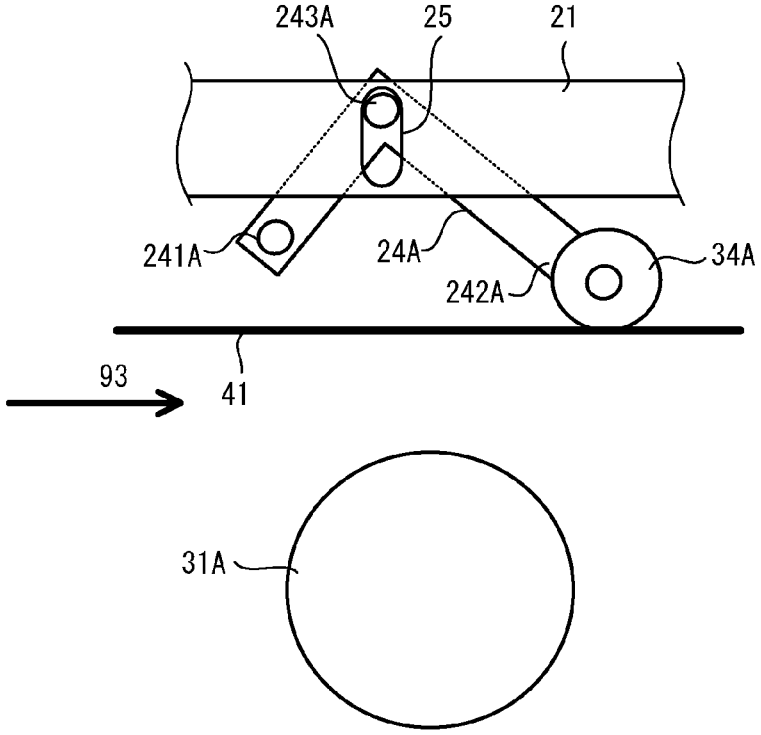
FIG. 5 is an enlarged view of apart of the transfer device, with FIG. 5A showing the primary transfer roller at a separate position, and FIG. 5B showing the primary transfer roller at a pressing position.
Figure 5B:
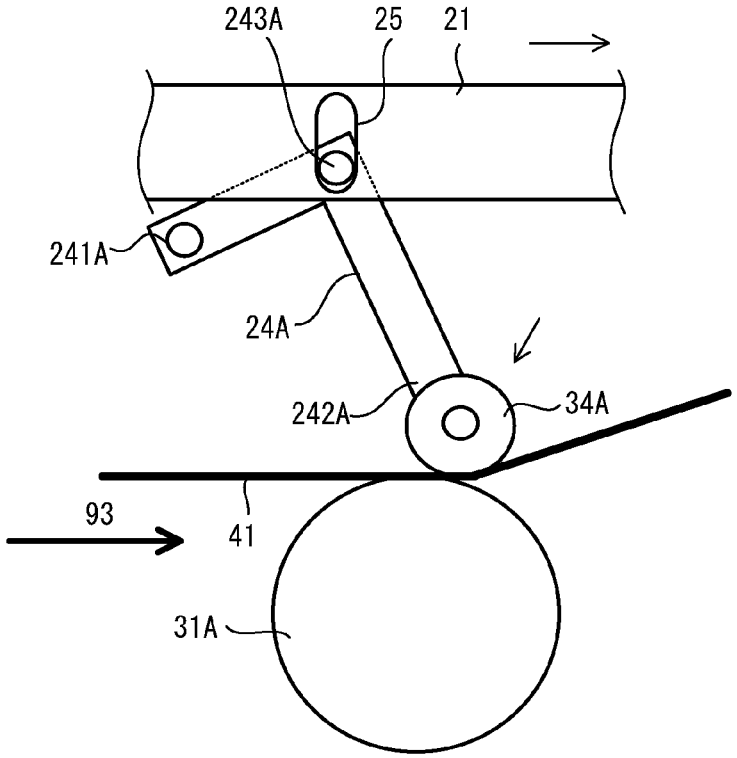

As shown in FIG. 5A and FIG. 5B, the first to fourth swinging members 24A through 24D each take a shape bent in L-character. The second to fourth swinging members 24B through 24D are configured in the same manner as the first swinging member 24A except for a direction of their installation to the second link member 22 in the direction of movement 93.

Figure 3B:
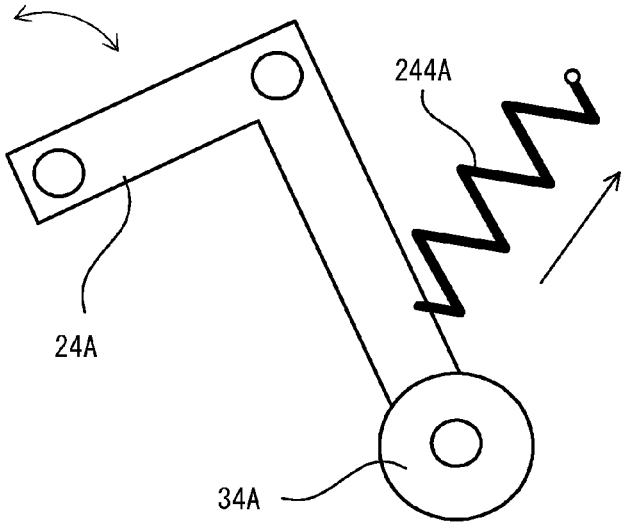
FIG. 3B is a drawing showing a configuration of a primary transfer roller.

A first end portion 241A of the first swinging member 24A is rotatably supported by a frame, which is not shown, of the intermediate transfer unit 40 at a position more to the photoreceptor drum 31A's side than the first link member 21. A second end portion 242A of the first swinging member 24A rotatably supports the primary transfer roller 34A. Likewise, respective first end portions of the second to fourth swinging members 24B through 24D are rotatably supported by the frame, which is not shown, of the intermediate transfer unit 40 at positions more to the photoreceptor drums 31B's through 31D's sides than the second link member 22. Respective second end portions of the second to fourth swinging members 24B through 24D rotatably support the primary transfer rollers 34B through 34D. As shown in FIG. 3B, the first swinging member 24A is urged by a spring 244A in a direction to separate from the photoreceptor drum 31A. Similarly, the second to fourth swinging members 24B through 24D are respectively urged by springs in directions to separate from the photoreceptor drums 31B through 31D. Here, in FIG. 5A and FIG. 5B, indication of the spring 244A is omitted.

The first link member 21 has a slit 25 that is long in a direction perpendicular to the direction of movement 93 at a position corresponding to the primary transfer roller 34A. The second link member 22 has slits that are long in the direction perpendicular to the direction of movement 93 at positions corresponding to the respective second to fourth primary transfer rollers 34B through 34D.

The first swinging member 24A has at a bent portion thereof a protruding section 243A projecting in a direction of a rotating shaft of the primary transfer roller 34A. The protruding section 243A is displaced in the slit 25 of the first link member 21 along the longitudinal direction of the slit 25. Protruding sections of the second to fourth swinging members 24B through 24D are displaced in respective slits of the second link member 22 along the longitudinal directions of the respective slits.

Therefore, as shown in FIG. 5B, when the first link member 21 moves in a direction to go farther from the cam shaft 231, namely, toward the downstream side in the direction of movement 93 of the intermediate transfer belt 41, the protruding section 243A moves downward in the slit 25 against an elastic force of the spring 244A; thus the primary transfer roller 34A descends and is displaced to the pressing position. This causes the intermediate transfer belt 41 to be pressed against the photoreceptor drum 31A. On the other hand, as shown in FIG. 5A, when the first link member 21 moves in a direction to come closer to the cam shaft 231, namely, toward the upstream side in the direction of movement 93, the protruding section 243A moves upward in the slit 25 with the elastic force of the spring 244A; thus the primary transfer roller 34A ascends and is displaced to the separate position. This causes the intermediate transfer belt 41 to be released from the photoreceptor drum 31A.

Likewise, when the second link member 22 moves in a direction to go farther from the cam shaft 231, namely, toward the upstream side in the direction of movement 93, the primary transfer rollers 34B through 34D descend and move to the respective pressing positions; and when the second link member 22 moves in a direction to come closer to the cam shaft 231, namely, toward the downstream side in the direction of movement 93, the primary transfer rollers 34B through 34D ascend and move to the respective separate positions.

Figure 6A:
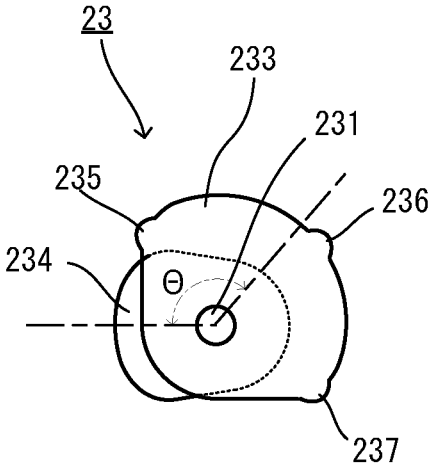
FIG. 6 is a drawing showing a structure of the cam, with FIG. 6A showing a front view of the cam, FIG. 6B showing a sectional view of a first cam section, and FIG. 6C showing a sectional view of a second cam section.

As shown in FIG. 6A, the cam 23 is made up of a first cam section 233 and a second cam section 234. The first cam section 233 and the second cam section 234 are formed in one united body with their positions shifted from one another in a direction of the cam shaft 231. The cam 23 turns around the cam shaft 231.

Figure 6B:
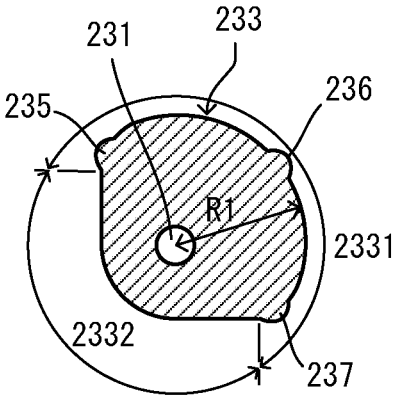

As shown in FIG. 6B, a peripheral surface of the first cam section 233 is made up of a generally circular arc part (hereinafter referred to as a pressed-contact generating face) 2331 at which a distance (radius) from the cam shaft 231 becomes relatively longer, and a release generating face 2332 at which a radius becomes shorter than that of the pressed-contact generating face.

Figure 6C:
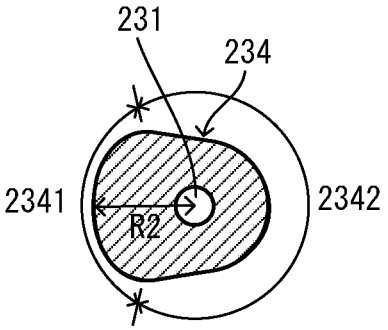

As shown in FIG. 6C, a peripheral surface of the second cam section 234 is made up of a generally circular arc part (hereinafter referred to as a pressed-contact generating face) 2341 at which a distance (radius) from the cam shaft 231 becomes relatively longer, and a release generating face 2342 at which a distance from the camshaft 231 becomes shorter than that of the pressed-contact generating face.

Radii R1, R2 of the pressed-contact generating faces 2331, 2341 of the first cam section 233 and the second cam section 234 are generally constant. R1 and R2 are generally equal. An angular range of the pressed-contact generating face 2331 of the first cam section 233 is set to, as an example, 90 degrees. An angular range of the pressed-contact generating face 2341 of the second cam section 234 is set to about one-half of the angular range of the pressed-contact generating face 2331 of the first cam section 233, and is therefore set to, as an example, 45 degrees. Accordingly, as to perimeters of the pressed-contact generating faces, the first cam section 233 should have about twice as much length as the second cam section 234. A phase difference θ between the pressed-contact generating face 2331 of the first cam section 233 and the pressed-contact generating face 2341 of the second cam section 234 is set to a value not greater than 180 degrees, and is set to, as an example, 135 degrees.

When viewed from the front face's side of the image forming apparatus 100 as in FIG. 1, the first link member 21, the cam 23 and the second link member 22 are arranged generally in a straight line. That is to say, the first link member 21 and the second link member 22 are aligned on either side of the camshaft 231 in such a manner that the longitudinal directions of the first link member 21 and the second link member 22 are in opposite directions to each other. In other words, an angle formed by the longitudinal directions of the first link member 21 and the second link member 22 in relation to the cam shaft 231 is 180 degrees. When the cam 23 turns, the first link member 21 and the second link member 22 each move in a horizontal direction with the alignment being maintained.

Figure 7A:
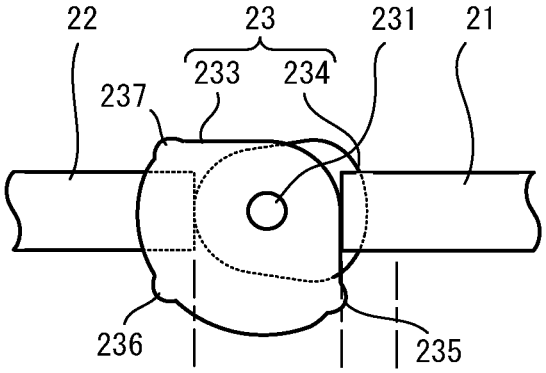
FIG. 7 is a drawing showing a state of disposition of the cam, with FIG. 7A showing a state of a standby mode, FIG. 7B showing a state of a monochromatic transfer mode, and FIG. 7C showing a state of a full-color transfer mode.

As shown in FIG. 7A, in the standby mode, the cam 23 is disposed at a predetermined first angle. This causes the first cam section 233 and the second cam section 234 to be in contact with the first link member 21 and the second link member 22 respectively at the release generating faces 2332, 2342 at which the distances from the camshaft 231 are short. As a result, both the first link member 21 and the second link member 22 come closer to the camshaft 231. This causes all the primary transfer rollers 34A through 34D to be disposed at separate positions, thereby causing the intermediate transfer belt 41 to be released from all the photoreceptor drums 31A through 31D.

Figure 7B:
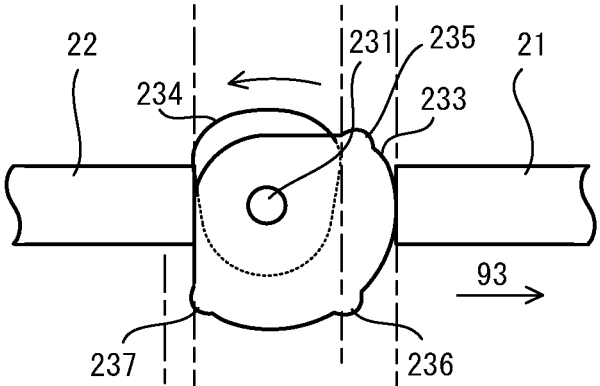

As shown in FIG. 7B, in the monochromatic transfer mode, the cam 23 is disposed at a predetermined second angle that is turned by 90 degrees counterclockwise in relation to a state of the standby mode, namely, the first angle. This causes the first cam section 233 to be in contact with the first link member 21 at the pressed-contact generating face 2331 at which the distance from the cam shaft 231 is long, and causes the second cam section 234 to be in contact with the second link member 22 at the release generating face 2342 at which the distance from the cam shaft 231 is short. As a result, the first link member 21 goes farther from the cam shaft 231, and the second link member 22 comes closer to the cam shaft 231. This causes the primary transfer roller for monochrome 34A to be displaced to the pressing position, thereby causing the intermediate transfer belt 41 to be pressed against the photoreceptor drum 31A. On the other hand, the primary transfer rollers 34B through 34D for color are disposed at the separate positions, thereby causing the intermediate transfer belt 41 to be released from the photoreceptor drums for color 31B through 31D. Then, each time when a job of monochromatic image forming is finished, the cam 23 is disposed at the above-mentioned first angle that is turned by 90 degrees clockwise in relation to the above-mentioned second angle, thereby returning to the state of the standby mode shown in FIG. 7A.

Figure 7C:
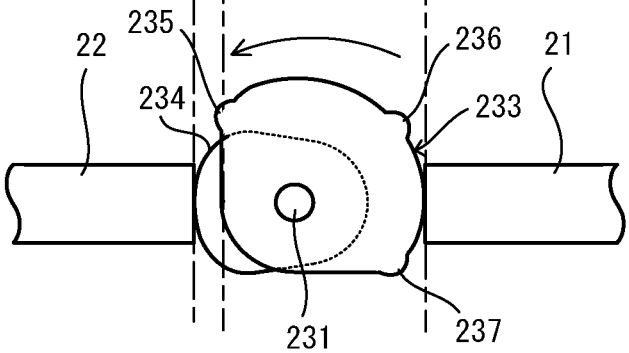

As shown in FIG. 7C, in the full-color transfer mode, the cam 23 is disposed at a predetermined third angle that is turned by 180 degrees counterclockwise in relation to the state of the standby mode, namely, the first angle. This causes the first cam section 233 and the second cam section 234 to be in contact with the first link member 21 and the second link member 22 respectively at the pressed-contact generating faces 2331, 2341 at which the distances from the cam shaft 231 are long. As a result, all the primary transfer rollers 34A through 34D are disposed at the pressing positions, thereby causing the intermediate transfer belt 41 to be pressed against all the photoreceptor drums 31A through 31D. Then, each time when a job of full-color image forming is finished, the cam 23 is disposed at the above-mentioned first angle that is turned by 180 degrees clockwise in relation to the above-mentioned third angle, thereby returning to the state of the standby mode shown in FIG. 7A.

Further, the peripheral surface of the first cam section 233 is provided with a first coming-off protection section 235, a second coming-off protection section 236, and a third coming-off protection section 237. The coming-off protection sections 235 through 237 are each formed, as an example, as a convex part with a smooth curved surface without corner. The convex part may be a projected narrow portion extending in the direction of the camshaft 231 on the pressed-contact generating face 2331, or even may be a protrusion provided partially in the middle in the direction of the cam shaft 231 of the pressed-contact generating face 2331. Moreover, even a configuration may be acceptable such that the coming-off protection sections 235 through 237 are formed as concave portions on the peripheral surface of the first cam section 233, and that a convex part that can engage with the concave portions is provided at one end of the link member 21.

As an example, the first and the third coming-off protection sections 235, 237 are formed at either end portion in a peripheral direction of the pressed-contact generating face 2331 of the first cam section 233. When this is expressed otherwise in terms of a counterclockwise turn of the cam 23, the first coming-off protection section 235 is located on the upstream side in the turning direction of the pressed-contact generating face 2331 of the first cam section 233, and the third coming-off protection section 237 is located on the downstream side in the turning direction. The second coming-off protection section 236 is formed between the first and the third coming-off protection sections 235, 237 in the peripheral direction of the pressed-contact generating face 2331 of the first cam section 233. As an example, the second coming-off protection section 236 is located in the middle in the peripheral direction of the pressed-contact generating face 2331 of the first cam section 233.

Figure 8A:
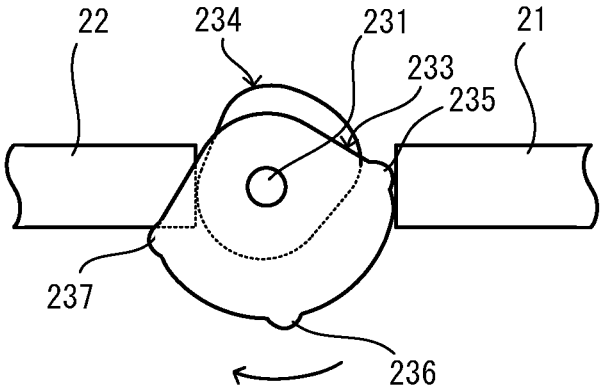
FIG. 8 is a drawing explaining functions of coming-off protection sections provided in the first cam section, with FIG. 8A showing a function of a first coming-off protection section, FIG. 8B showing a function of a second coming-off protection section, and FIG. 8C showing a function of a third coming-off protection section.

In the monochromatic transfer mode shown in FIG. 7B, the first coming-off protection section 235 serves to prevent the first link member 21 from coming off the pressed-contact generating face 2331 to the release generating face 2332 of the first cam section 233. That is, as shown in FIG. 8A, even when the cam 23 turns clockwise unintentionally due to the occurrence of a sliding between the pressed-contact generating face 2331 of the first cam section 233 and the first link member 21, the first coming-off protection section 235 serves as an obstacle, beyond which the first link member 21 cannot move. Therefore, further turn of the cam 23 is blocked. As a result, coming off of the first link member 21 is prevented, and thus the transfer of a black toner image onto the intermediate transfer belt 41 is stabilized.

Figure 8B:
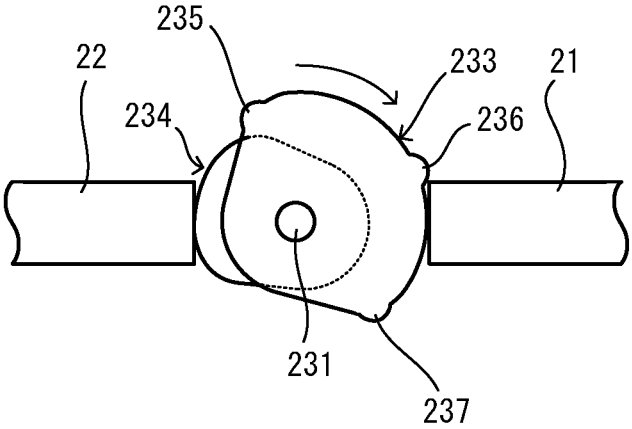

In the full-color transfer mode shown in FIG. 7C, the second coming-off protection section 236 serves to prevent the second link member 22 from coming off the pressed-contact generating face 2341 to the release generating face 2342 of the second cam section 234. That is, as shown in FIG. 8B, even when the cam 23 turns clockwise unintentionally due to the occurrence of a sliding between the pressed-contact generating face 2331 of the first cam section 233 and the first link member 21, the second coming-off protection section 236 serves as an obstacle, beyond which the first link member 21 cannot move. Therefore, further turn of the cam 23 is blocked. This serves to prevent the second link member 22 from coming off on the side of the second cam section 234. As a result, the transfer of color toner images onto the intermediate transfer belt 41 is stabilized.

Figure 8C:
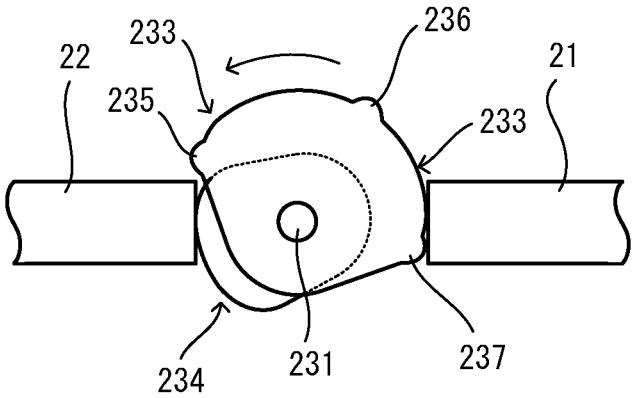

In the full-color transfer mode shown in FIG. 7C, the third coming-off protection section 237 serves to prevent the first link member 21 from coming off the pressed-contact generating face 2331 to the release generating face 2332 of the first cam section 233. That is, as shown in FIG. 8C, even when the cam 23 turns counterclockwise unintentionally due to the occurrence of a sliding between the pressed-contact generating face 2331 of the first cam section 233 and the first link member 21, the third coming-off protection section 237 serves as an obstacle, beyond which the first link member 21 cannot move. Therefore, further turn of the cam 23 is blocked. As a result, coming off of the first link member 21 is prevented, and thus the transfer of the black toner image onto the intermediate transfer belt 41 is stabilized.

Further, in the full-color transfer mode shown in FIG. 7C, the third coming-off protection section 237 also serves to prevent the second link member 22 from coming off the pressed-contact generating face 2341 to the release generating face 2342 of the second cam section 234 (refer to FIG. 8C). However, the third coming-off protection section 237 does not necessarily have to serve also as a coming-off protection section for the second link member 22 in the full-color transfer mode; instead, such a coming-off protection section may be formed separately as a fourth coming-off protection section.

As described above, a most distinguished feature of the present invention is that one or more coming-off protection sections (the second and the third coming-off protection sections 236, 237) for preventing the coming off of the second link member 22 which is the link member for color is provided in a cam section for monochrome (the first cam section 233). In other words, it is not necessary to provide a coming-off protection section in the second cam section 234 which is the cam section for color requiring a large rotatory torque. This eliminates the need for a coming-off protection section of the cam section for color to act on the link member for color when the cam 23 is turned by a driving source, thereby making it possible to suppress the occurrence of an increase of the rotatory torque and a deficiency of clutch capacity for transmitting the driving force to the cam shaft.

The above explanations of the embodiments are nothing more than illustrative in any respect, nor should be thought of as restrictive. Scope of the present invention is indicated by claims rather than the above embodiments. Further, it is intended that all changes that are equivalent to a claim in the sense and realm of the doctrine of equivalence be included within the scope of the present invention.

REFERENCE SIGNS LIST

10 transfer device
20 transfer member moving mechanism

21 first link member (link member for monochrome)
22 second link member (link member for color)
23 cam
231 cam shaft
233 first cam section (cam section for monochrome)
2331 pressed-contact generating face
2332 release generating face
234 second cam section (cam section for color)
2341 pressed-contact generating face
2342 release generating face
235 first coming-off protection section
236 second coming-off protection section
237 third coming-off protection section
31A photoreceptor drum for monochrome (image bearing member for monochrome)
31B, 31C, 31D photoreceptor drums for color (image bearing members for color)
34A primary transfer roller for monochrome (primary transfer member for monochrome)
34B, 34C, 34D primary transfer rollers for color (primary transfer members for color)
41 intermediate transfer belt
100 image forming apparatus

The invention claimed is:

1. An image forming apparatus comprising:
one image bearing member for monochrome;
a plurality of image bearing members for color; and
a transfer apparatus comprising:
an intermediate transfer belt constituting a loop-like path of movement;
one primary transfer member for monochrome capable of being displaced in contact-separation directions facing the one image bearing member for monochrome;
a plurality of primary transfer members for color capable of being displaced in contact-separation directions respectively facing the plurality of image bearing members for color;
a cam formed as an eccentric cam made up of a first cam section and a second cam section that are to be turned around an identical cam shaft, both sections being displaced from one another in a direction of the cam shaft and fixed to each other;
a first link member to which the one primary transfer member for monochrome is connected and which is urged toward the cam and which is movable along a longitudinal direction thereof within a predetermined range, being in contact with a peripheral surface of the first cam section; and
a second link member to which the plurality of primary transfer members for color is connected and which is urged toward the cam and which is movable along a longitudinal direction thereof within a predetermined range, being in contact with a peripheral surface of the second cam section;
the one image bearing member for monochrome and the one primary transfer member for monochrome that are disposed facing each other and the plurality of image bearing members for color and the plurality of primary transfer members for color that are disposed facing each other being disposed sequentially along the intermediate transfer belt sandwiching the intermediate transfer belt;
the transfer device being capable of taking the modes below selectively depending on a rotational angle of the cam:
a standby mode in which by keeping the first link member and the second link member respectively in a state of being in contact with release generating faces of the first cam section and the second cam section the primary transfer member for monochrome and the primary transfer members for color are respectively caused to be displaced in directions to separate from the image bearing member for monochrome and the image bearing members for color, thereby causing the intermediate transfer belt to be released from the image bearing member for monochrome and the image bearing members for color;
a monochromatic transfer mode in which by keeping the first link member in a state of being in contact with a pressed-contact generating face of the first cam section the primary transfer member for monochrome is caused to be displaced in a direction to approach the image bearing member for monochrome and thereby causes the intermediate transfer belt to be pressed against the image bearing member for monochrome, and in which by keeping the second link member in a state of being in contact with the release generating face of the second cam section the primary transfer members for color are caused to be displaced in the directions to separate from the image bearing members for color and thereby causes the intermediate transfer belt to be released from the image bearing members for color; and
a full-color transfer mode in which by keeping the first link member and the second link member respectively in a state of being in contact with pressed-contact generating faces of the first cam section and the second cam section the primary transfer member for monochrome and the primary transfer members for color are respectively caused to be displaced in the directions to approach the image bearing member for monochrome and the image bearing members for color, thereby causing the intermediate transfer belt to be pressed against the image bearing member for monochrome and the image bearing members for color; wherein
the transfer device further comprising, on the peripheral surface of the first cam section:
a first coming-off protection section that is configured to prevent the first link member from coming off the pressed-contact generating face to the release generating face of the first cam section in the monochromatic transfer mode, and
a second coming-off protection section that is configured to prevent the second link member from coming off the pressed-contact generating face to the release generating face of the second cam section in the full-color transfer mode.

2. The image forming apparatus as claimed in claim 1 further comprising a third coming-off protection section that is provided on the peripheral surface of the first cam section for preventing the first link member from coming off the pressed-contact generating face to the release generating face of the first cam section in the full-color transfer mode.

3. The image forming apparatus as claimed in claim 2 wherein the third coming-off protection section also serves as a coming-off protection section for preventing the second link member from coming off the pressed-contact generating face to the release generating face of the second cam section in the full-color transfer mode.

4. The image forming apparatus as claimed in claim 1 wherein the first coming-off protection section and the second coming-off protection section are each formed as a convex part with a smooth curved surface.

5. The image forming apparatus as claimed in claim 2 wherein the first coming-off protection section, the second coming-off protection section, and the third coming-off protection section are each formed as a convex part with a smooth curved surface.

6. The image forming, apparatus as claimed in claim 3 wherein the first coming-off protection section, the second coming-off protection section, and the third coming-off protection section are each formed as a convex part with a smooth curved surface.

* * * * *